US005313862A

United States Patent [19]

Johansson

[11] Patent Number: 5,313,862

[45] Date of Patent: May 24, 1994

[54] APPARATUS FOR CUTTING

[75] Inventor: Kjell Johansson, Falkenberg, Sweden

[73] Assignee: Core Link AB, Falkenberg, Sweden

[21] Appl. No.: 952,720

[22] PCT Filed: May 21, 1991

[86] PCT No.: PCT/SE91/00366

§ 371 Date: Nov. 23, 1992

§ 102(e) Date: Nov. 23, 1992

[87] PCT Pub. No.: WO91/17855

PCT Pub. Date: Nov. 28, 1991

[30] Foreign Application Priority Data

May 22, 1990 [SE] Sweden ..... 9001835-9

[51] Int. Cl.[5] ..... B26D 1/18

[52] U.S. Cl. ..... 83/156; 82/53.1; 83/54; 83/318; 83/337

[58] Field of Search ..... 82/53.1; 83/156, 318, 83/54, 319, 320, 337

[56] References Cited

U.S. PATENT DOCUMENTS 1,643,994 10/1927 Parsons ..... 82/53.1 X
3,044,336 7/1962 Bock ..... 83/319
3,540,333 11/1970 Johnson ..... 82/53.1
4,299,147 11/1981 Rogers ..... 82/53.1 X
4,591,405 5/1986 Languillat ..... 82/53.1 X
4,756,217 7/1988 Holmes ..... 82/53.1
4,823,579 4/1989 Castricum ..... 82/53.1 X

FOREIGN PATENT DOCUMENTS 3803553 8/1989 Fed. Rep. of Germany ..... 82/53.1

*Primary Examiner*—Richard K. Seidel
*Assistant Examiner*—Kenneth E. Peterson
*Attorney, Agent, or Firm*—Antonelli, Terry, Stout & Kraus

[57] ABSTRACT

An apparatus for cutting a cylindrical sleeve (7) during continuous displacement of the sleeve (7) in its longitudinal direction, for example in connection with continuous manufacture of the sleeve (7) in an appropriate machine. The apparatus includes a longitudinal slide (30) which is displaceable synchronously with the sleeve (7) during rotation thereof and movement in its longitudinal direction. A knife (36) is impressible into the wall of the sleeve (7) during longitudinal displacement of the slide (30) and the sleeve (7). The knife (36) is mounted on a cross slide (39,40; 43,44) which is reciprocal transversely of the longitudinal axis of the sleeve (7), and thereby transversely of the direction of movement of the longitudinal slide (30) for impressing the knife (36) into the wall of the sleeve (7) for cutting a desired length of the sleeve.

6 Claims, 5 Drawing Sheets

APPARATUS FOR CUTTING

The present invention relates to an apparatus for cutting cylindrical sleeves during the continuous displacement of the sleeve in its longitudinal direction, for example in connection with continuous manufacture of the sleeve in an appropriate machine, the apparatus including a longitudinal slide which is displaceable synchronously with the sleeve during its rotation and movement in the longitudinal direction, and which is provided with a knife which is impressible into the wall of the sleeve during the rotation and longitudinal displacement of the longitudinal slide and the sleeve.

There are many prior art apparatuses of the above-disclosed type for cutting sleeves for use in, for example, the papermaking industry. The sleeves may advantageously be manufactured in direct association with the cutting apparatus by alternating helical windings of paper and/or cardboard webs on a support pipe to the desired material thickness of the sleeve. The finished sleeve is often fed direct into a cutting apparatus and, therefore, as a rule has not completely dried when cutting is to take place, but displays a certain degree of softness. Naturally, this places stringent and special requirements on the cutting apparatus which must execute the cutting operation during the rotation and continuous longitudinal displacement of the sleeve without any unacceptable deformation of the end of the sleeve or the incision surface itself. The prior art apparatuses are of extremely complex design and construction, entailing many drawbacks in the form of operational downtime, sleeve rejection, etc.

The task forming the basis of the present invention is to improve prior art cutting apparatuses for achieving more rational sleeve cutting than hitherto, this moreover without resulting in any deterioration in the desired quality of the incision face.

This task is solved according to the present invention in the apparatus disclosed by way of introduction, in that the knife is mounted on a cross slide which is reciprocal transversely of the longitudinal direction of the sleeve and, thereby, transversely of the direction of movement of the longitudinal slide for urging the knife into the wall of the sleeve for cutting a desired length of the sleeve. The cross slide has a forward, knife-carrying section and a rear section guiding the reciprocal movement during the longitudinal displacement, these sections being interconnected by means of a piston and cylinder assembly, partly for fixing the mutual position of the sections, and partly for mutually displacing the sections to and away from one another. The sections are mounted on a number of rails for the movement transversely of the longitudinal axis of the sleeve, and the rear section has a guide pin which extends into a guide groove along the sleeve and is displaced reciprocally in the guide groove during the movement of the longitudinal slide synchronously with the sleeve and back to its starting position. The forward section displays an arm which, at its free end, carries a freely rotatable knife and, at its opposing end, is longitudinally displaceably mounted on the forward section, whereby the free portion of the arm, outside the forward section, is adjustable for adaptation to different diameters of the sleeve. The longitudinal slide is coupled to an end arm by means of a rod which extends along the sleeve, and the distance between the longitudinal slide and the end arm is adjustable in response to the desired length of the cut sleeve, a piston and cylinder assembly being disposed between a fixed portion in the apparatus and the longitudinal slide in order to cooperate in the displacement thereof with the sleeve and in order to return the slide and end arm to their starting positions after the cutting operation. The end arm is pivotal away from the end of the sleeve by means of a piston and cylinder assembly. On either side of the sleeve, there are disposed support rollers which are mounted on pivotal arms for rolling off a cut sleeve in either direction. The longitudinal slide is provided with two mutually registering cross slides which are substantially identical and are arranged to execute substantially the same, but mutually counter-directed movement patterns.

The present invention provides an apparatus possessing extraordinary properties, primarily in respect of cutting continuously manufactured sleeves. The incision face obtained will be very even, considering both the incision proper and the entire end surface. The apparatus according to the present invention permits extremely rational cutting of continuously manufactured sleeves at relatively high speed but without any deterioration in the desired quality of the incision face and the end surface proper. Furthermore, the apparatus according to the present invention is extremely versatile and permits very rapid switching to different sleeve dimensions, in respect of both length and diameter of the sleeve. Without any particularly major modifications, it will further appear possible to render the apparatus fully automated and to continuously cut sleeves of different lengths. Moreover, the apparatus according to the present invention is of simple design and construction, which guarantees a high degree of operational dependability and relatively simple maintenance.

The present invention will now be described in greater detail hereinbelow, with particular reference to the accompanying Drawings.

Figure 1:
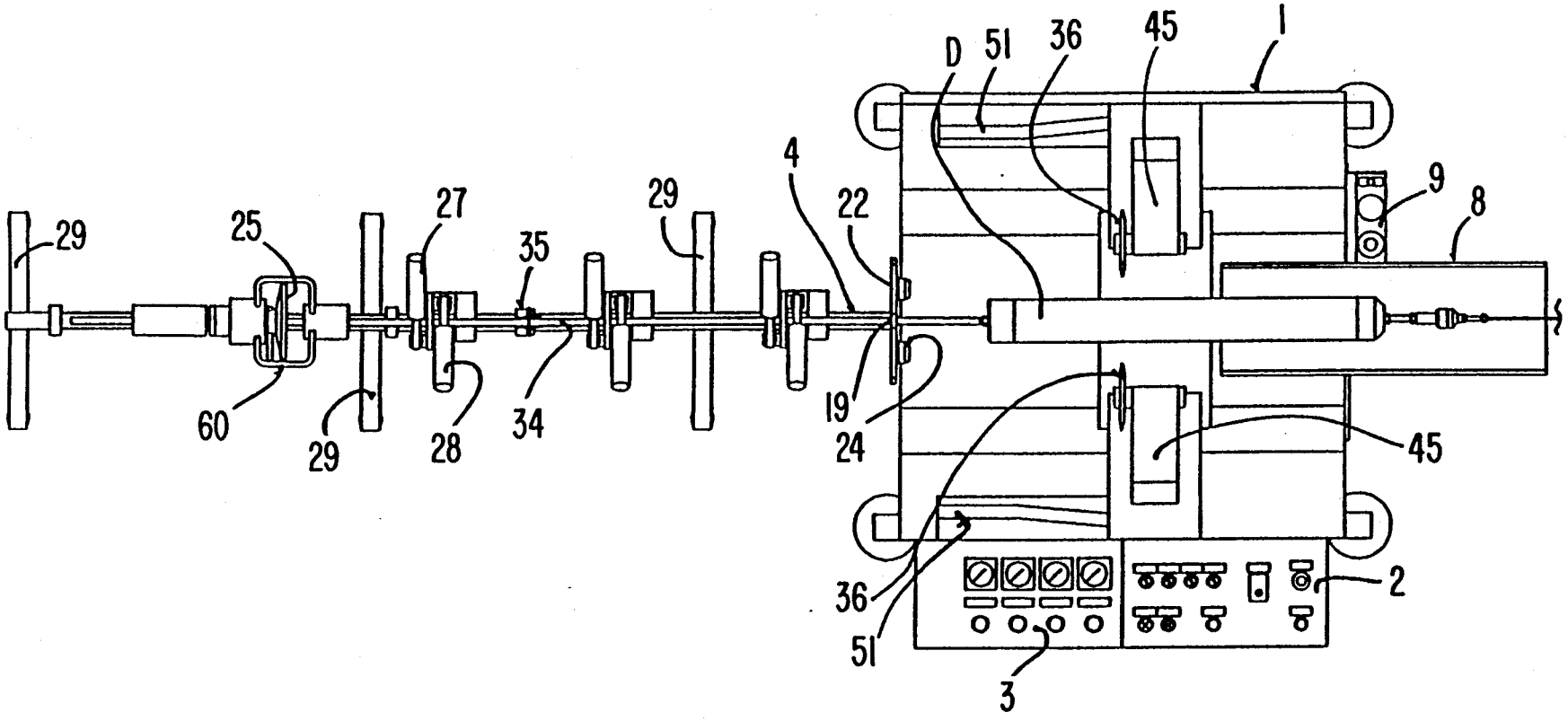
FIG. 1 is a top plan view of a part of an apparatus according to one embodiment of the present invention.

The embodiment of an apparatus according to the present invention as shown in FIGS. 1–5 is a prototype and is intended for the cutting of sleeves which are manufactured in immediate association with the illustrated apparatus. In this process, a number of paper and/or cardboard strips, or strips of other suitable material, are helically wound on each other on a support pipe, during rotation and continuous longitudinal displacement of the completed sleeve. A suitable glue is applied between the strips. When the finished sleeve arrives at the apparatus shown on the drawings, the pipe converts into a longitudinally displaceable mandrel D which accompanies the sleeve in order to form a substrate at the cutting site and is thereafter returned to a starting position in order to accompany the next sleeve up to the cutting site, so that the cutting operation always takes place with the mandrel acting as a substrate. These parts are to be found in prior art apparatuses of similar type, for which reason they are not shown on the drawings or described in any great detail.

The apparatus according to the present invention is constructed around a clad frame 1 which, in addition to the frame for the apparatus, houses automation and regulation equipment 2 and an operating panel 3. A square rod or square tube 4 extends through the frame or cabinet 1, this tube being optionally quadratic and adjustable with respect to the distance out from the cabinet or frame 1 that the rod 4 is to project. The rod 4 is positionally fixable by means of clamping devices 5 and 6 on both the discharge side and the infeed side. The rod 4 extends along the longitudinal axis of the sleeve. On the infeed side of the apparatus, there is disposed a largely U-shaped cradle 8 in which the sleeve 7 may rest during longitudinal displacement through the apparatus. The cradle 8 is mounted on an arm 9 which in turn is mounted on the end of a piston and cylinder assembly 10 for movement of the cradle 8 to and from the longitudinal axis of the sleeve 7. By means of a screw with an end wheel which has a handle, the arm 9 and the cradle 8 are vertically adjustable in relation to the piston and cylinder assembly for adaptation to the diameter of the sleeve 7.

At the opposing end of the apparatus in relation to the cradle 8, there is provided an upstanding support arm 19 which is Y-shaped, the vertically upstanding portion of the arm 19 being provided with a longitudinal recess 20 for cooperation with a clamping device for fixing the arm 19 in the desired vertical position. The mutually diverging shanks 22 of the arm 19 are provided with a number of spaced-apart holes 23 for journalling a support wheel or support roller 24 at a suitable distance from the vertical section of the arm 19, in order to create a suitable support for the sleeve 7.

Basically, that portion of the sleeve 7 which is to be cut off is to pass the arm 19 and the rollers 24, and the end of the sleeve abuts against an end disk 25 on an end arm 26. A number of angled support rollers 27, 28 are disposed between the arm 19 and the end disk 25, the number of support rollers being adapted to the length of that sleeve 7 which is to be cut off. The end arm 26 and the support rollers 27, 28 are mounted on that section of the rod 4 which extends out from the cabinet of frame 1. The rod 4 is supported from a support surface by means of a number of legs 29. The end arm 26 and the support rollers 27, 28 will be described in greater detail later in this specification.

A longitudinal slide 30 is disposed on the frame or cabinet 1 and is displaceable along two parallel rails 31 disposed on either side of the longitudinal axis of the sleeve 7. The cross section of the rails 31 is substantially I-shaped, the web being relatively robust and the corners between the web and the flanges forming paths for balls in a carriage 32. The longitudinal slide 30 is mounted on a suitable number of carriages 32 in order to be readily displaceable in the longitudinal direction of the axis of the sleeve 7. The piston in a piston and cylinder assembly 33 is interconnected with the longitudinal slide 30, while the cylinders in the assembly 33 are mounted on the frame. Thus, the piston and cylinder assembly 33 may cooperate in the longitudinal displacement of the longitudinal slide 30. By means of a round bar 34, the longitudinal slide 30 is fixedly connected to the end arm 26. The bar 34 extends straight over the square rod 4, and a number of support rollers 35 may be provided on the rod 4. The distance, fixed by the bar 34, between the end arm 26 (or, more precisely, the end disk 25) and the longitudinal slide 30 (or, more precisely the knife 36 disposed thereon) corresponds to the desired length of that sleeve 7 which is to be cut.

The length of that sleeve 7 which is to be cut is thus determined by the length of the bar 34. The length of the bar 34 may be adjustable, or different segments of the bar 34 may be replaceable by others for achieving the desired length of the sleeve 7.

On the longitudinal slide 30, there are disposed mutually registering rails 37 on either side of the longitudinal axis of the sleeve 7. The rails 37 may be of the same type as the rails 31, and there are disposed thereon a suitable number of carriages 38 of the same type as the carriage 32. On the pairwise disposed rails 37, there are provided two pairs of forward carriages 38 and two pairs of rear carriages 38. The forward carriage pair 38 is interconnected with a plate 39 which carries an upstanding anchorage 40 for a piston rod 41 in a piston and cylinder assembly 42. The rear carriage pair 38 is interconnected with a plate 43 which carries a frame 44 in which the cylinder in the piston and cylinder assembly 42 is secured. An arm 45 is disposed on the plate 39, the forward end of this arm carrying the knife 36 which is freely rotatable. A safety hood 46 is disposed on the rear side of the knife. The rear end of the arm 45 is displaceably mounted on rods 47 and is interconnected with a threaded rod 48A for displacement of the arm 45 along the rods by means of a wheel 48B on the end of the threaded rod. The position of the knife 36 outside the frame 44 is, thus, adjustable with the aid of the wheel 48B, while the entire cross slide which is formed by the parts carried by the carriages 38 is displaceable transversely of the longitudinal axis of the sleeve 7 largely between the positions of the knife 36 shown by ghosted and solid lines. The forward and rear sections of the cross slide are interconnected to one another by means of the piston and cylinder assembly 41, 42, which results in there is a displacement possibility between the forward section and the rear section, and that the coupling between the two portions may be fixed and, in principle, disconnected or released.

Figures 2, 2A:
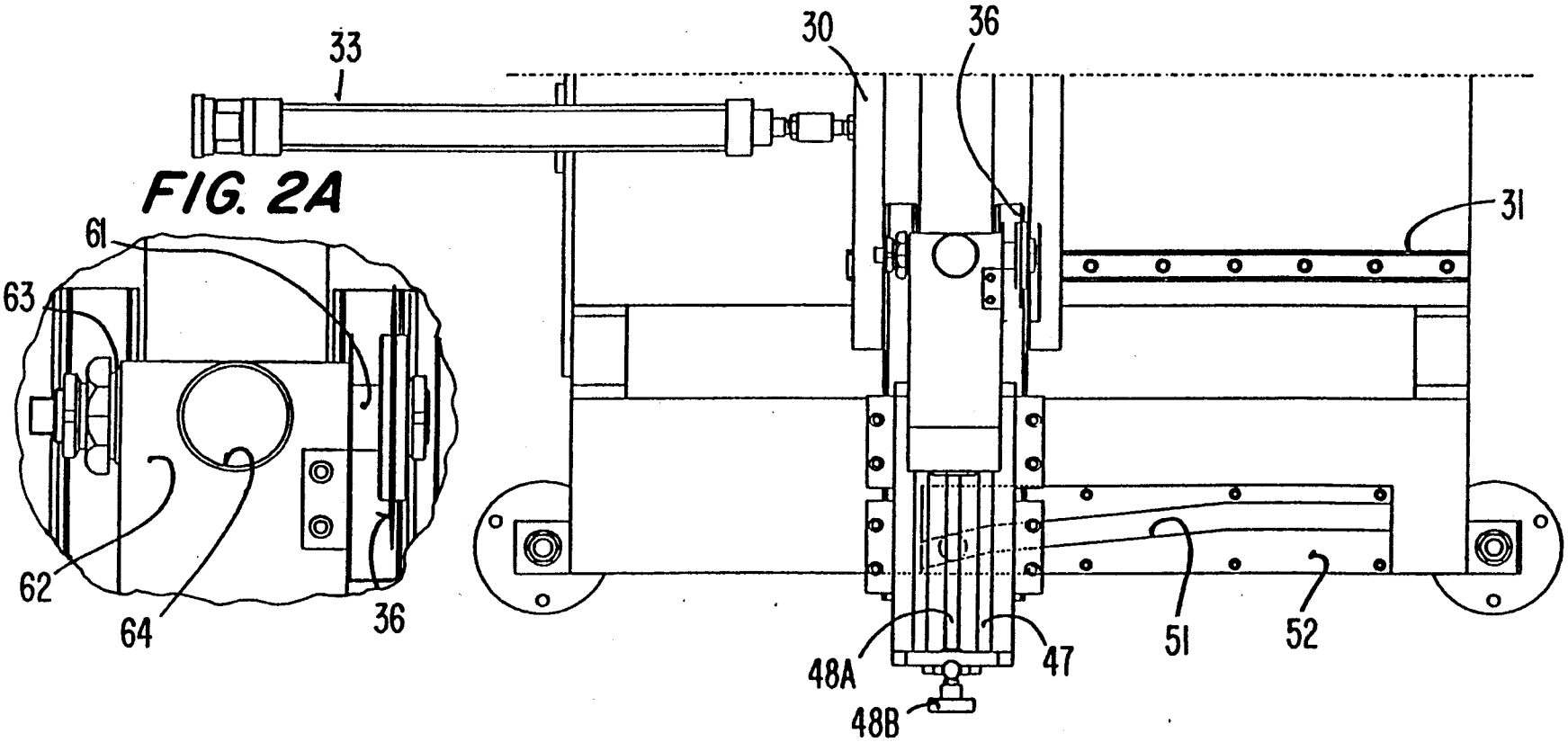
FIG. 2 is a top plan view of a part of an apparatus according to the present invention, an encircled section being shown on a larger scale in FIG. 2A.
Figure 3:
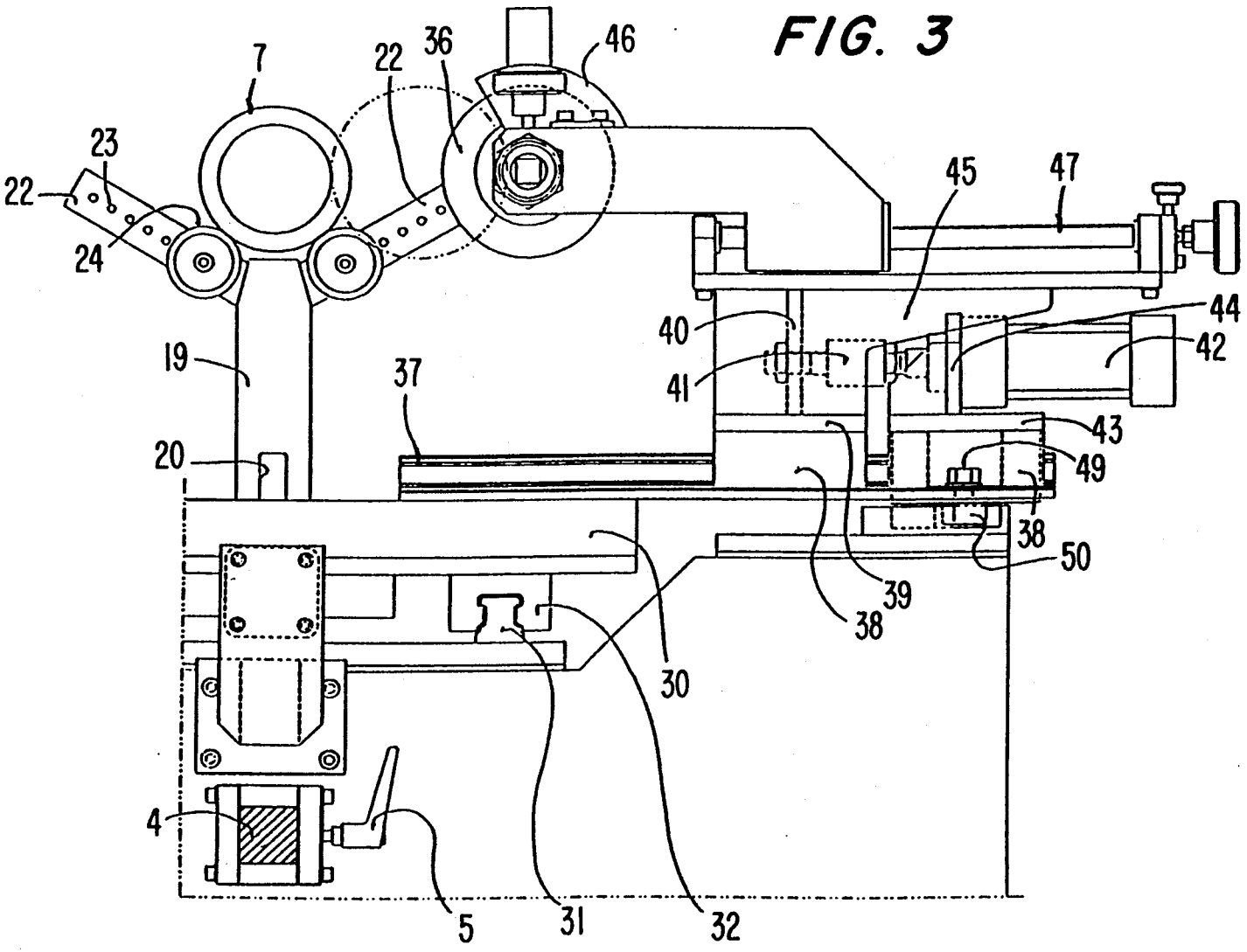
FIG. 3 is a side elevation of the part shown in FIG. 2.
Figure 4:
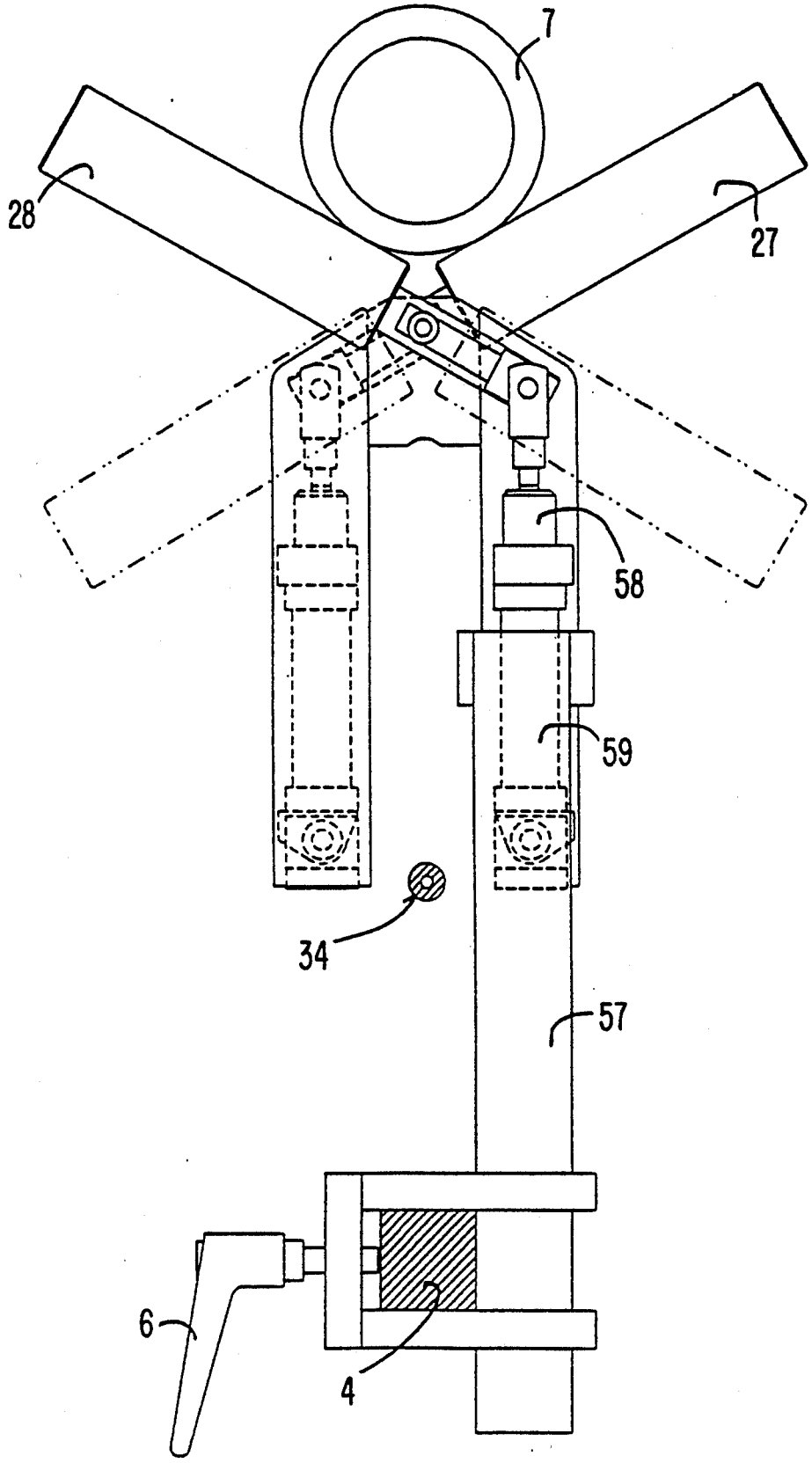
FIG. 4 is a side elevation of a part of the apparatus according to the present invention.

For displacing the cross slide towards and away from the sleeve 7, there is provided, on the underside of the plate 39 between the carriages 38, a holder 49 with a pin 50 which advantageously carries a ball bearing which extends down into a guide groove 51 in a plate 52 which is secured on the frame or cabinet 1. The guide grove 51 in the plate 52 is rectilinear and extends first at an angle of approx. 4.5° to the longitudinal axis of the sleeve 7 and thereafter substantially parallel with the longitudinal axis of the sleeve 7. In FIG. 2, the pin 50 is shown in the starting position of the cross slide, which corresponds to the starting position of the longitudinal slide 30. Since the longitudinal slide 30 moves reciprocally between the left-hand end of the plate 52 and the right-hand end of the plate 52, the cross slide will move radially in towards and out away from the longitudinal axis of the sleeve 7 and parallel therealong. During the movement in the obliquely inclined portion of the guide groove 51, the cross slide will urge the knife 36 into and through the wall of the sleeve 7. The end arm 26 is displaceable on a rail 53 of the same type as the rails 31 and 37 and is mounted on a carriage 54 of the same type as the carriages 32 and 38. When the sleeve 7 meets the end disk 25, the arm 26 will be displaced along the rail 53 and, via the bar 34, entrain the longitudinal slide 30 and the cross slides mounted thereon, whereupon the knives 36 will be urged into the wall of the sleeve 7 and therethrough, because of the guiding of the cross slides by means of the pins 50 in the guide grooves 51 of the guide plates 52 on either side. When the pin 50 has reached that portion in the guide groove 51 parallel with the longitudinal axis of the sleeve, penetration cutting of the wall of the sleeve 7 will have been completed, and the piston and cylinder assembly 42 may be caused to disengage the forward and rear sections from one another so as to avoid damage to the mandrel located in the sleeve 7. This is, naturally, a particularly great advantage if the mandrel is of steel, whereby damage to both the knife 36 and the mandrel can be avoided.

Figure 5:
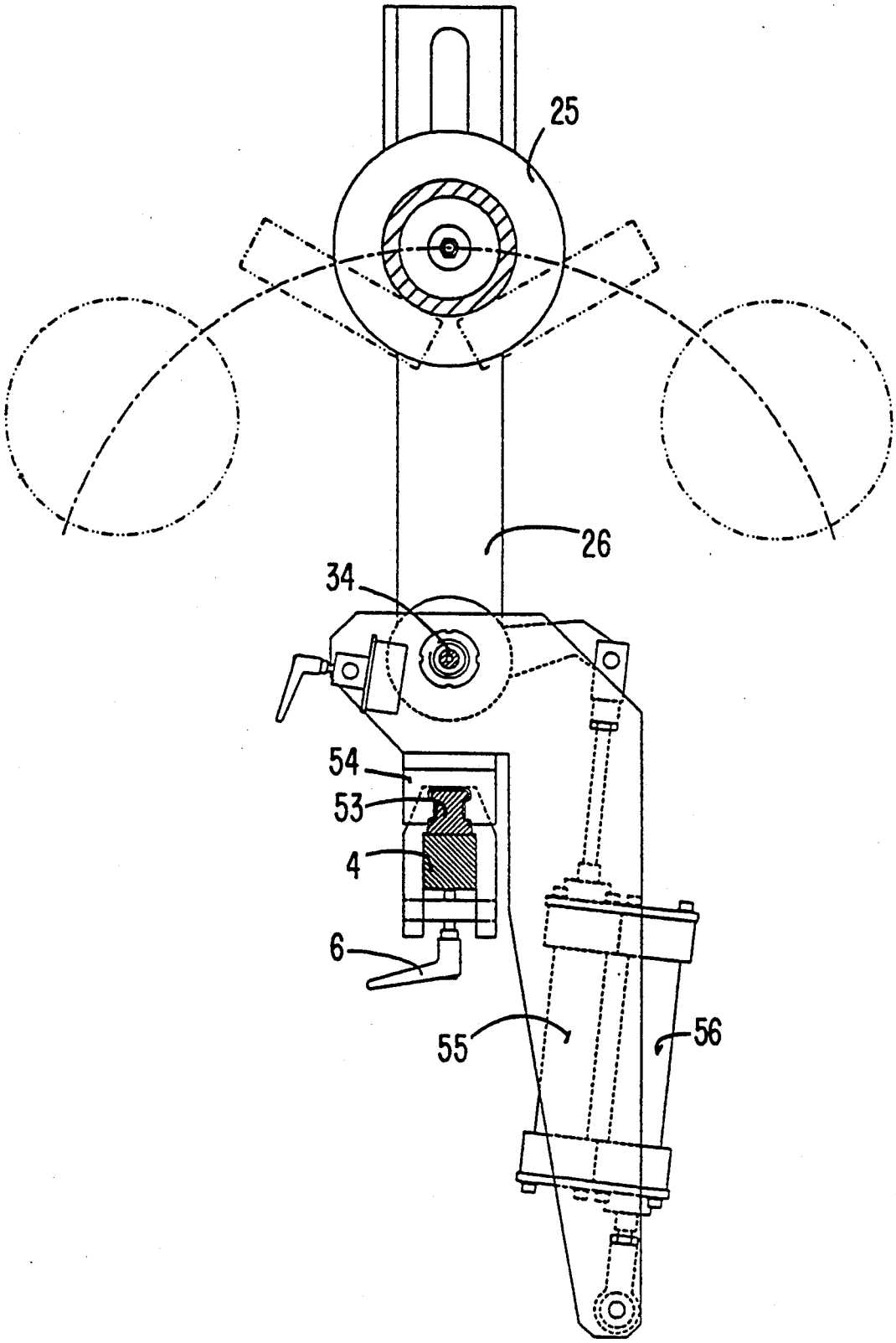
FIG. 5 is a side elevation of a part of the apparatus of FIG. 1.

When the knives 36 have penetrated a distance into the wall of the sleeve 7, driving of the longitudinal slide 30 is taken over by the piston and cylinder assembly 33 which is also employed, on the one hand, to initiate and thereafter support displacement of the longitudinal slide 30 after engagement with the end arm 26 and, on the other hand, for return of the longitudinal slide 30 to its starting position. Since the piston and cylinder assembly 33 takes over the forward driving of the longitudinal slide 30 during the penetration of the knives 36, the end arm 26 may be pivoted away from its engagement with the end of the sleeve 7 in either direction, with the aid of a piston and cylinder assembly 55 for pivoting the arm 26 in one direction and in the other direction. FIG. 5 shows the positions by means of ghosted lines, like the support rollers 27 and 28. The incision face will thereby be improved. The cut sleeve 7 resting on the support rollers 27, 28 is removed therefrom by pivoting either the support rollers 27, which are located on one side of the longitudinal axis of the sleeve 7, or the support rollers 28, which are located on the opposite side of the longitudinal axis of the sleeve 7. The support rollers 27, 28 are each rotatably disposed on their rod which is pivotally disposed on an arm 57 which extends down to the rod 4. The opposing end of the rod in relation to the rollers 27, 28 is connected to the piston 58 in a piston and cylinder assembly 59 which is secured on the arm 57. The arm 57 extends over to the opposite side of the support roller 27 and there carries an additional piston and cylinder assembly which is identical to the piston and cylinder assembly 59. Thus, the cut sleeve may be removed from the machine in one direction or the other.

On the end arm 26, there is further disposed a yoke 60 which serves to retain the end of the sleeve 7 at the end disk 25. The vertical position of the yoke 60 is adjustable to permit setting thereof in correspondence with the diameters of the sleeve 7.

The mounting of the knife 36 proper is shown in greater detail in FIG. 2A. The knife 36 is secured to one end of a shaft 61 which is journalled in a housing 62 which, in turn, is adjustable in a casing 63 and fixable by means of a wheel 64. Naturally, this adjustment possibility permits fine adjustment of the position of the knife.

It is clearly apparent from FIG. 1 that the longitudinal slide 30 is provided with two mutually registering cross slides, and that these operate towards one another in one and the same incision in the sleeve 7.

Many modifications are conceivable without departing from the spirit and scope of the inventive concept as defined in the appended claims.

I claim:

1. An apparatus for cutting a cylindrical sleeve (7) as the sleeve (7) is continuously displaced in its longitudinal direction, during continuous manufacture of the sleeve (7), the apparatus comprising:

a longitudinal slide (30) which is displaceable synchronously with the sleeve (7) during rotation and movement of the sleeve in its longitudinal direction;

a knife (36);

a cross slide (39,43) having the knife (36) mounted thereon, the cross slide (39,43) being reciprocal transversely of the longitudinal direction of the sleeve (7), and thereby transversely of the direction of movement of the longitudinal slide (30), for impressing the knife (36) into the wall of the sleeve (7) during longitudinal displacement of the longitudinal slide (30) and the sleeve (7), for cutting a desired length of the sleeve (7), the cross slide (39,43) having a forward, knife-carrying section (43,44) and a rear section (39,40) guiding the reciprocal movement during the longitudinal displacement;

a piston and cylinder assembly (41,42) interconnecting the cross slide sections (43, 44; 39,40) with one another, for fixing the mutual position of the sections and for disengaging the sections (39,40; 43,44) from one another after movement a predetermined distance in towards the longitudinal axis of the sleeve (7);

a plurality of rails (37) having the cross slide sections (39,40; 43,44) mounted thereon for the movement transversely of the longitudinal axis of the sleeve (7);

a plate member (52) having a guide groove (51) extending therealong, the guide groove over at least a part of its length being angled obliquely relative to the sleeve (7); and a guide pin (50) extending from the rear section (39,40) into the guide groove (51) to reciprocate in the guide groove (51) during movement of the longitudinal slide (30) synchronously with the sleeve (7) and back to its starting position.

2. The apparatus as claimed in claim 1, further comprising:

a plurality of support rollers (27,28); and pivotal arms disposing the rollers on either side of the sleeve (7) for rolling off a cut sleeve (7) in either direction.

3. The apparatus as claimed in claim 1, wherein the knife (36) is a freely rotatable knife, and wherein the forward section (43,44) includes an arm (45) having the knife at its free end, and at its opposing end is longitudinally displaceably mounted on the forward section, whereby the free portion of the arm (45) outside the forward section is adjustable for adaptation to different diameters of the sleeve (7).

4. The apparatus as claimed in claim 1, further comprising:

an end arm (26);

a bar (34) extending adjacent the sleeve (7) and coupling the longitudinal slide to the end arm so that the distance between the longitudinal slide (30) and the end arm (26) is adjustable to the desired length of the cut sleeve (7); and a second piston and cylinder assembly (33) disposed between a fixed portion (1) of the apparatus and the longitudinal slide (30) for cooperating in displacement thereof with the sleeve (7) and for returning the longitudinal slide (30) and the end arm (26) to their starting positions after the cutting operation.

5. The apparatus as claimed in claim 4, further comprising a third piston and cylinder assembly (55,56) for pivoting the end arm (26) away from the end of the sleeve (7).

6. The apparatus as claimed in claim 4, wherein the longitudinal slide (30) includes two mutually registering, substantially identical further cross slides arranged to execute substantially the same, but mutually counter-directed movement patterns.

* * * * *